US006922604B2

(12) United States Patent
Höeller

(10) Patent No.: US 6,922,604 B2
(45) Date of Patent: Jul. 26, 2005

(54) PROCESS AND DEVICE FOR ADJUSTING CLEARING LIMITS

(75) Inventor: Robert Höeller, Uster (CH)

(73) Assignee: Uster Technologies AG, Uster (CH)

( * ) Notice: Subject to any disclaimer, the term of this patent is extended or adjusted under 35 U.S.C. 154(b) by 325 days.

(21) Appl. No.: 09/994,721

(22) Filed: Nov. 28, 2001

(65) Prior Publication Data

US 2002/0062775 A1 May 30, 2002

Related U.S. Application Data

(63) Continuation-in-part of application No. PCT/CH00/00284, filed on May 22, 2000.

(30) Foreign Application Priority Data

May 29, 1999 (CH) ..... 1008/99

(51) Int. Cl.[7] ..... G06F 19/00
(52) U.S. Cl. ..... 700/144; 356/430
(58) Field of Search ..... 700/144, 143, 700/142, 130; 73/160, 159; 703/6; 356/429, 430, 431, 238.2; 250/559.24, 559.46, 559.05

(56) References Cited

U.S. PATENT DOCUMENTS 5,671,061 A * 9/1997 Hoeller ..... 356/429
6,374,152 B1 * 4/2002 Wepfer et al. ..... 700/144
6,501,086 B1 * 12/2002 Leuenberger ..... 356/429 X
6,510,734 B1 * 1/2003 Feller ..... 73/160

FOREIGN PATENT DOCUMENTS

| | | |
|---|---|---|
| CH | 477573 | 8/1969 |
| DE | 4020330 A1 | 1/1991 |
| EP | 0578975 A1 | 1/1994 |
| EP | 0 877 108 A1 | 11/1998 |
| WO | 97/47959 | 12/1997 |
| WO | 98/16823 | 4/1998 |

OTHER PUBLICATIONS

International Preliminary Examination Report for International Application No. PCT/CH00/00284.

* cited by examiner

*Primary Examiner*—Peter Nerbun
(74) *Attorney, Agent, or Firm*—Burns Doane Swecker & Mathis, LLP

(57) ABSTRACT

The invention relates to a process and a device for adjusting clearing limits, defects in the yarn being cut out and a clearing limit separating defects which are to be cut out from defects which are not to be cut out. To achieve an improved, simplified and rapid adjustment of the clearing limit so the effect thereof in the end product can also be predicted more accurately, starting from the clearing limit, displays of defects in the end product are to be produced which make an effect of the defects in the end product visible.

38 Claims, 7 Drawing Sheets

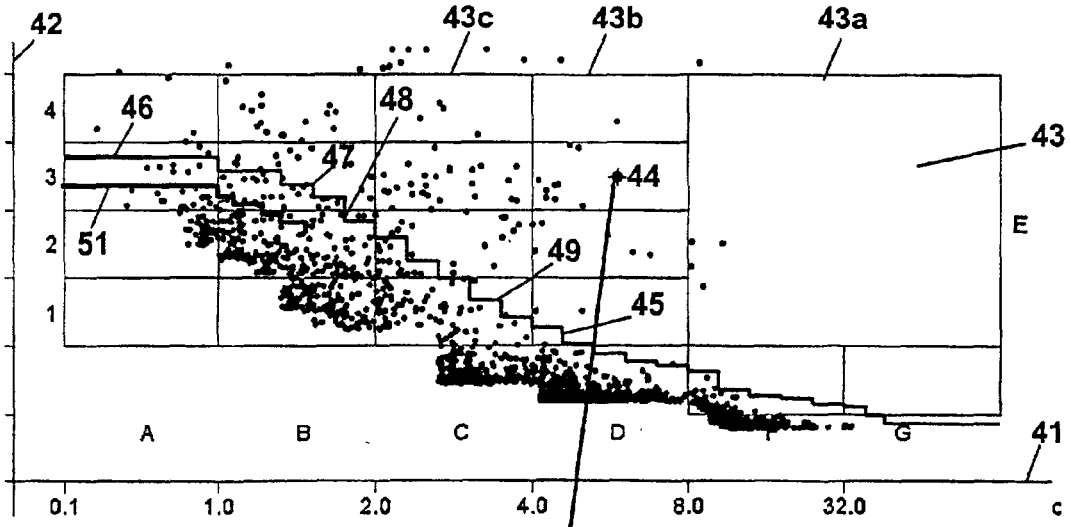
Fig. 9
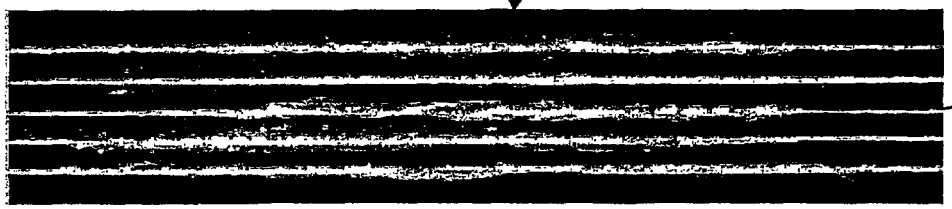
Fig. 10
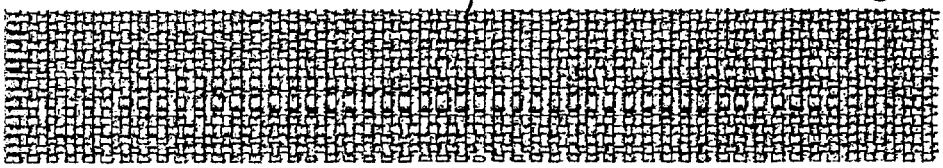
Fig. 11
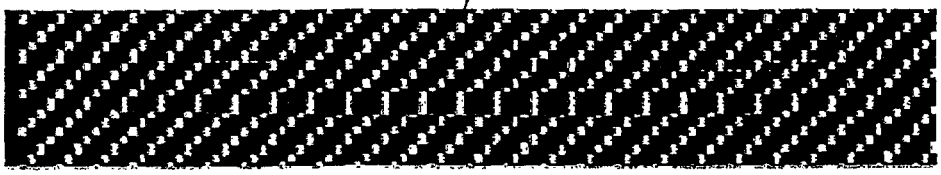
Fig. 12
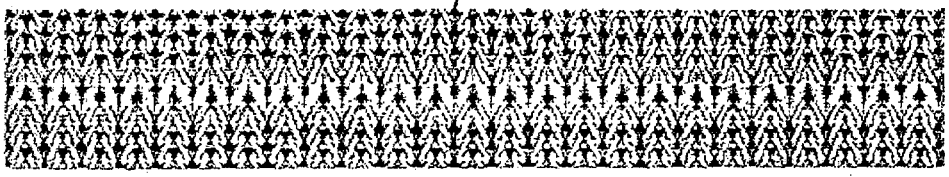

PROCESS AND DEVICE FOR ADJUSTING CLEARING LIMITS

RELATED APPLICATIONS

This application is a continuation-in-part of, and claims priority under 35 U.S.C. §120 to, International Application No. PCT/CH00/00284, filed on May 22, 2000, which International Application was published by the International Bureau in German on Dec. 7, 2000 (International Publication No. WO 00/73189), and claims priority under 35 U.S.C. §119 to Swiss Application No. 1008/99, filed May 29, 1999, the entire contents of each of which are incorporated by reference herein.

BACKGROUND

1. Field of the Invention

The invention relates to a process and a device for adjusting clearing limits that seperate defects in yarn which are to be cut out from defects which are not to be cut out.

2. Background Information

In devices of this type, which are also called yarn clearers, it is conventional to manually adjust a clearing limit in that adjustment values are input in a control apparatus to establish a clearing curve.

This process is very complicated, because good clearing limits can only be found by complicated trials. This means that, with a first clearing limit, yarn is produced and the quality of the yarn and the products produced therefrom is then tested, whence data for the adjustment of a new improved clearing limit has to be found. The clearing limit which has been found must then also finally be adjusted in a plurality of control apparatuses on spinning frames.

A process and a device of the above-mentioned type are known from EP 0 877 108 in which the clearing limit is adjusted automatically. To this end, yarn defects are detected from a first yarn portion, in that values for the thickness and length of thickness variations of the yarn are measured and collected. With the aid of a computer, for example a so-called PC which contains a suitable program, these values can be sorted and displayed in a graph, the values for the thickness and the associated values for the length of the defects being entered in a length/thickness graph. In this graph value ranges for various lengths of defects in the yarn are plotted along one axis and value ranges for the thickness of the defect in the yarn along another axis. Rectangular fields are thus produced which are limited by respective upper and lower limits for the length and upper and lower limits for the thickness of the defect. Defects detected in the yarn can now be entered in the fields in this graph, so for each thickness and length range the number of detected defects is determined and the defect density in this range is obtained.

Since with accurate measurements on the yarn even small deviations in the thickness from an average or from a predetermined value are detected, very many values and therefore also a very large defect density are obtained for these small deviations. These values can be allocated to a so-called "yarn package". They do not belong to real defects, as in practice they merely reflect the normal structure of the yarn. Only deviations in the thickness which exceed a specific measure are noteworthy. In a first approximation, therefore, the defect density can be ascertained as a measure of the size or significance of the defect, namely as follows: The higher the defect density, the less disruptive is the corresponding defect. An optimum clearing limit should accordingly combine points with identical defect density or identical defect size in one defect graph. Defects which lie on this clearing limit are thus respectively equally disruptive. In this process, the operator inputs the number of clearer cuts into the PC and thus obtains the optimum clearing limit. If the operator agrees with the curve obtained, he loads this into the memory of a control apparatus for the yarn cleaner which continues to work therewith.

A disadvantage of this known process is that the clearing limit is determined on the basis of values for an admissible number of cuts to the yarn. Therefore, the quality of the yarn and the subsequent products possibly needs to be checked and the clearing limit then adapted again.

SUMMARY OF THE INVENTION

The invention as characterized in the claims achieves the object of providing a process and a device which avoid these disadvantages and allow an improved, simplified and rapid adjustment of the clearing limit, so the effect thereof in the yarn can also be predicted more accurately.

This is achieved in that the values, detected by the control apparatus of the yarn clearer on each yarn defect, for the length, thickness and position along the yarn are evaluated in a new manner. By thickness, we are here selectively referring to variables such as defect radius, defect cross-section or also defect mass. A graphic illustration of the clearing limit is not necessary. Rather a set of simulated yarn defects is displayed in an image, wherein the image, as described hereinafter can have various forms. In any case, the images always only show defects which lie on the same clearing limit. However, the defects can have varying form and length.

With reference to defects which lie on this clearing limit and are displayed: the most disruptive defects in the yarn are those which still remain after clearing the yarn, in other words are not removed by clearing. Even slightly larger defects are, however, cut out. Simulated defect images are shown as defects in the images. Therefore, for each defect with a predetermined length and thickness, images or displays of the images have to be simulated and/or prestored. As a defect which is characterized by a pair of values for its length and thickness can have various forms in practice, it is even desirable to store a plurality of images or displays for a single defect to take possible variations of form into consideration.

As a basis for the simulation, pattern tables are used which show yarn defects of defined length and thickness in these different variations of form. There are at least three possibilities for displaying the yarn defects. Firstly, individual yarn portions provided with defects can be shown approximately in actual size. Secondly, small cut-outs from a sample fabric which contain yarn defects can be shown and, thirdly, larger fabric cut-outs can be shown where, in particular, the two-dimensional distribution of the defects in the fabric is recognizable.

The device according to the invention therefore has yarn clearers known per se which are connected to a spinning or winding frame and a computer (PC) which in its memory has displays of defects and a program for classifying the defects. The computer also has means for displaying defect examples and contains prestored displays of defects or a program for displaying defects from input data. It preferably also has selectable fields via which the calculation of a clearing limit can be triggered.

The advantages achieved by the invention are in particular that the adjustment of the clearing limit is greatly simplified and therefore can be carried out even by relatively modestly qualified operators. The effect of the adjustment made can also be recognized very accurately. In particular, however, the clearing limit can be influenced and determined by the desired quality of an end product. This quality which, for example, is expressed in the more or less even texture of the surface of a woven or knitted fabric can be considered directly when the clearing limit for the yarn is determined. The display of the defects can emphasize both the type of defects or the effect of the distribution of the defects in the end product.

BRIEF DESCRIPTION OF THE DRAWING FIGURES

Other objects and advantages of the present invention will become apparent to those skilled in the art upon reading the following detailed description of preferred embodiments, in conjunction with the accompanying drawings, wherein like reference numerals have been used to designate like elements, and wherein:

FIG. 1 is a schematic view of the device according to exemplary embodiments of the present invention;

FIGS. 2 to 7 each show defects in the display field;

FIG. 9 is a representation of a clearing limit;

FIGS. 10, 11 and 12 are examples of simulated fabrics of different types;

DETAILED DESCRIPTION OF THE PREFERRED EMBODIMENTS

Figure 1:
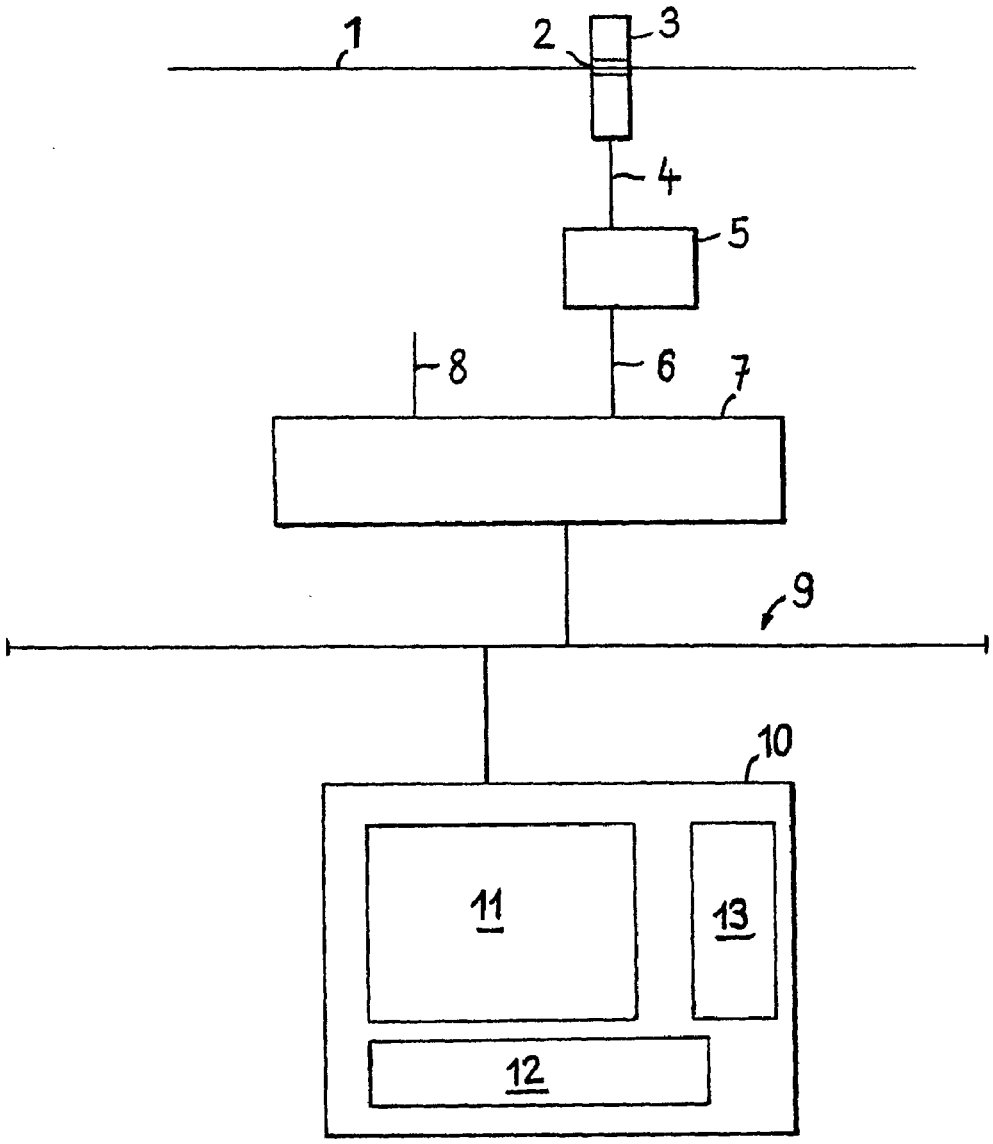

FIG. 1 shows a test piece moved longitudinally, here a yarn 1 which passes through a measuring gap 2 of a yarn clearer 3. The yarn clearer 3 is connected via a line 4 to an evaluation unit 5 which in turn is connected via a bus 6 to a control apparatus 7. Further evaluation units and therefore further yarn clearers can be connected via a further bus 8 to the control apparatus 7. The control apparatus 7 is connected via a bus or a network 9, such as, for example, Ethernet (LAN) etc. to a computer 10 which can, for example, be a conventional PC with display means. The PC thus also has the known elements such as screen 11, input keyboard 12 and processor 13. Various programs are stored in the computer 10, for example a program for fabric simulation, a program for establishing a first clearing limit and a program for producing defect images and storing predetermined defect images. A program for simulating fabric is commercially available under the name USTER EXPERT and described in principle in U.S. Pat. No. 5,671,061. A program for establishing a clearing limit is sold by the company ZELLWEGER USTER under the name CAY and is known in principle from EP 0 877 108. Typical defect images in the yarn are known from the classification system USTER CLASSIMAT and shown, for example, in the document "USTER News Bulletin" No. 29, August 1981 on pages 4, 6 and 15.

Figure 2:
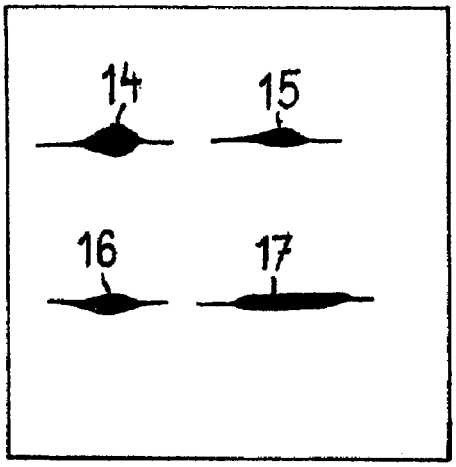

FIG. 2 shows an example of defects in an end product such as yarn which could be on the same clearing limit and therefore are undesired or tolerated to the same degree and therefore can be allocated to points of a clearing limit. The defect 14 is called a short thick point, the defect 17 a long thick point which, however, has a smaller thickness. The defects 15 and 16 are somewhere in between in their measurements.

Figure 3:
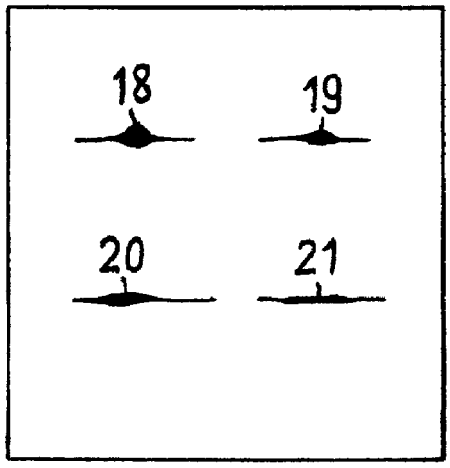

FIG. 3 shows similar defects to FIG. 2 which, however, have a smaller thickness in total and therefore should be less disruptive. This display emphasizes the type of defects.

Figure 4:
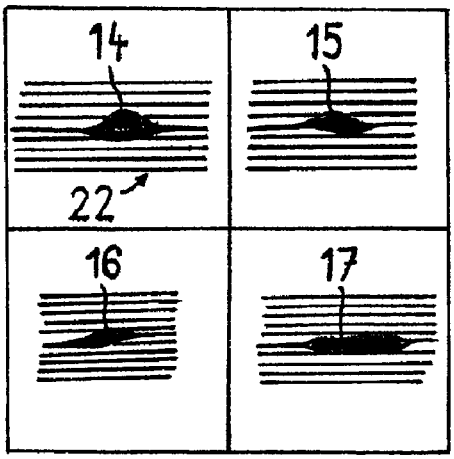

FIG. 4 shows the same defects 14 to 17 as FIG. 2, but in a cutout from a fabric.

Figure 5:
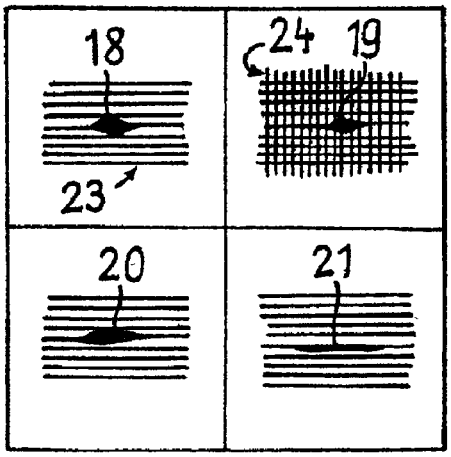

FIG. 5 shows the same defects 18 to 21 as FIG. 3, but in an environment.

Figure 6:
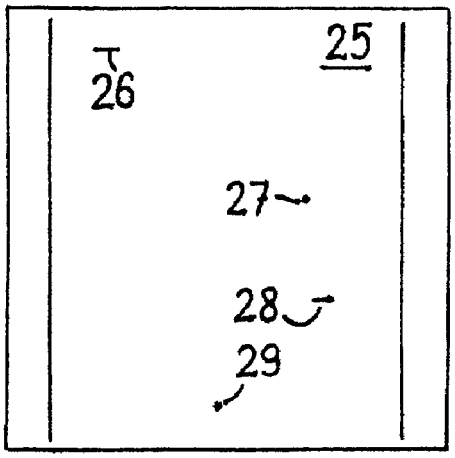

FIG. 6 shows a web 25 of a woven or knitted fabric, in which yarn defects are denoted by reference numerals 26 to 29.

Figure 7:
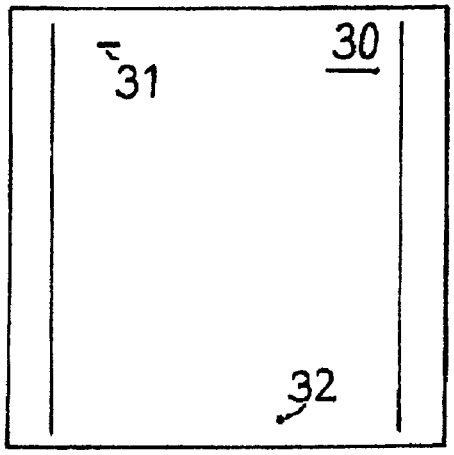

FIG. 7 shows a web 30 of a woven or knitted fabric, in which yarn defects are denoted by reference numerals 31 and 32. This view emphasizes the distribution of the defects in the end product.

Figure 8:
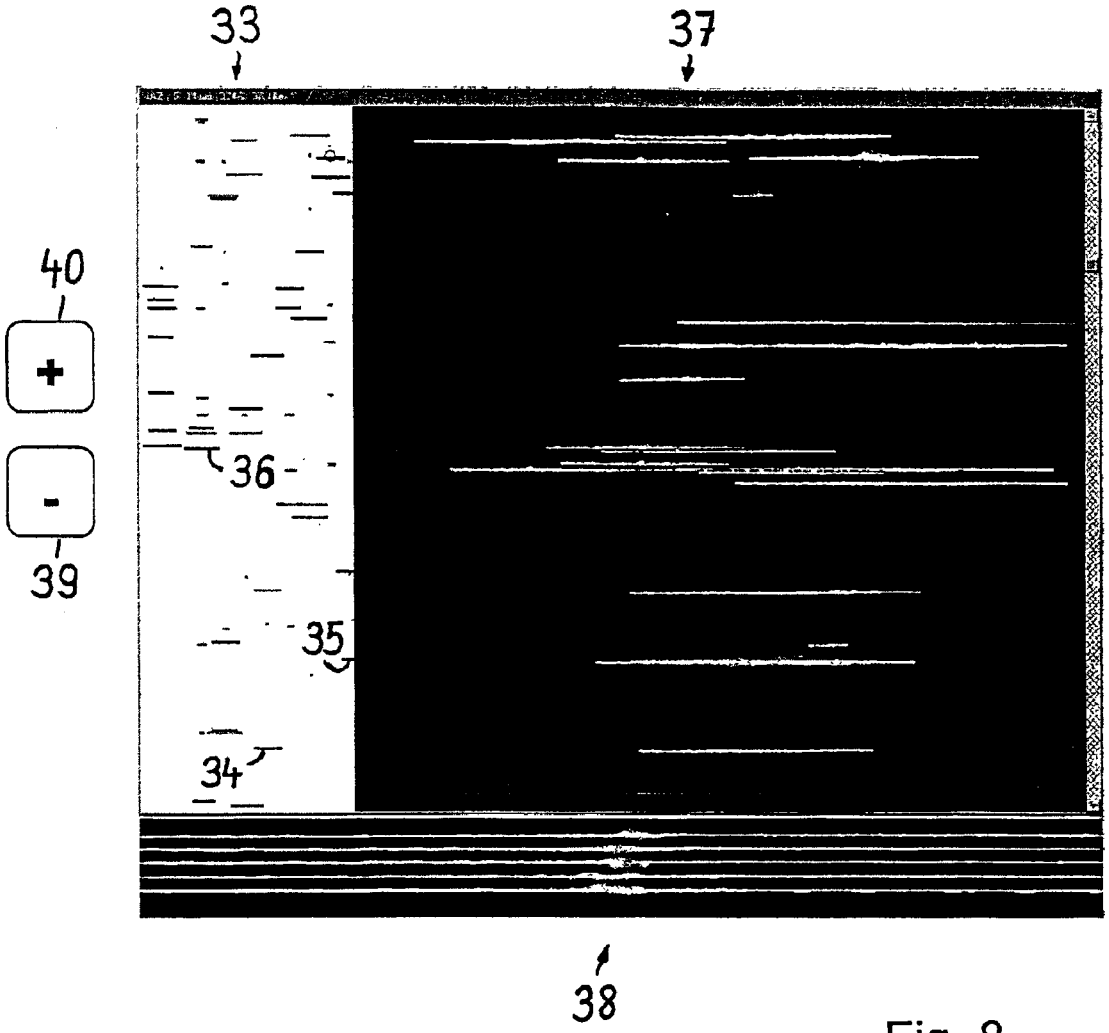
FIG. 8 is an illustration of a computer display of a yarn with defects.

FIG. 8 shows the view as it can be constructed on a screen. A web 33 of an end product such as a woven or knitted fabric has visible yarn defects, as denoted, for example, by 34, 35 and 36. In a field 37 to the right thereof, these yarn defects are enlarged and shown at the same level, so the nature thereof can be recognized. Five different variations are shown in field 38 for one and the same defect. All these variations are classified in the same field as they are felt to be equally disruptive, although their shapes differ from one another. Field 39 and 40 can be selected, for example by a mouse. Selection of field 39 restricts the clearing limit and selection of field 40 makes it more tolerant.

FIG. 9 shows a horizontal axis 41, along which values for a first dimension or parameter of yarn defects are recorded. In this particular example, the parameter of interest is length. Deviations of the diameter (or mass) of a yarn in relation to a mean diameter (or mean mass) are plotted as a second dimension or second parameter along a vertical axis 42. Illustrated in a plane defined by these two axes 41 and 42 are fields 43, in particular fields 43*a*, 43*b*, 43*c*, etc., which define classes of yarn defects, e.g., of the type described in CH 477 573 and generally known by the name USTER CLASSIMAT. Yarn defect measurements are indicated in a plane or in the fields 43 by crosses or points. Cross 44, for example, indicates that the length of the yarn defect is about 6.2 cm and its thickness or mass exceeds the mean diameter or the mean mass by 320%. A clearing limit is denoted here by a dark line 45, and defines which yarn defects are removed or cut out of the yarn and which are not. Thus, yarn defects represented by crosses lying between the axis 41 and the clearing limit 45 are not cut out and hence do not lead to splicing or knotting of the yarn. In a first approximation it may be stated here that the clearing limit 45 goes around accumulations of clouds of crosses or points, and hence of yarn defects, in such a way that the latter lie between the axis 41 and the clearing limit 45. Window 50 opens when cross or point 44 is activated and shows several possible defects with the same parameters. A corresponding window can be opened for any other cross or point present in the fields 43.

FIG. 10 shows a simulated fabric 52 of a first type having one yarn therein which may have a defect corresponding to cross or point 44 in FIG. 9.

FIG. 11 shows a simulated fabric 53 of a second type having one yarn therein which may have a defect corresponding to point 44 in FIG. 9.

FIG. 12 shows a simulated fabric 54 of a third type having one yarn therein which may have a defect corresponding to point 44 in FIG. 9.

The operating method of the invention is as follows. Prior to or at the beginning of yarn production or for a specific production lot, a clearing limit such as clearing limit 45 (FIG. 9) is input. This can take place, for example, in the manner known from EP 0 877 108 and corresponding U.S. application Ser. No. 09/064,718. In any case, this clearing limit must finally be prestored in the computer 10 or be determined by a suitable program. Yarn defects, for example, which can be allocated to this clearing limit as shown next to one another or in succession in one of FIG. 2, 4 or 6 are then shown on the screen 11 in the end product, i.e., in the yarn 1, in the woven or knitted fabric 25, 30, 52, 53, 54. The operator can choose between, for example, three displays as shown in FIGS. 2, 4 and 6 or displays shown in FIGS. 10, 11, 12. Assuming that defect 14 as shown in FIG. 2 corresponds to one point 46 on clearing limit 45, further assuming that defect 16 as shown in FIG. 2 corresponds to one point 47 on clearing limit 45, that defect 15 as shown in FIG. 2 corresponds to one point 48 on clearing limit 45, and that defect 17 as shown in FIG. 2 corresponds to one point 49 on clearing limit 45 in FIG. 9, then, the operator can now judge whether or not he can allow the shown defects in the yarn based on his appraisal made with help of the representation of said defects 14 to 17 in FIGS. 2, 4 and/or 6. FIG. 6 will especially show him how the defects may be distributed in the woven fabric. Or, the operator can choose any other point in the fields 43, for example, as shown with point 44 and display corresponding defects in the yarn such as represented in window 50, or display simulations of different kinds of fabric made with such yarn and comprising said defect corresponding to point 44. FIG. 10 shows the said defect for yarn used for a plain weave, FIG. 11 shows the said defect for yarn used for a twill weave and FIG. 12 shows the said defect for yarn used for a single jersey.

Using one or several representations such as shown in FIGS. 2, 4 and 6 or 9 to 12, the operator can decide if he would accept such defect or not. If he cannot allow them, he has perhaps adjusted his clearing limit too insensitively. He can restrict it in that he makes a corresponding input on the input keyboard 12 or selects the field 39 (FIG. 8) on the screen 11 via a mouse. The processor 13 then calculates a new clearing limit which cuts out more defects and new images of defects appear on the screen 11 as shown, for example, by FIGS. 3, 5 and 7. These examples may, e.g., correspond to a clearing limit as represented by dark line 51 in FIG. 9.

Conversely, the clearing limit can also be adjusted more tolerantly, for example in that the field 40 is selected with a click of the mouse. As a check, the number of expected clearer cuts for each clearing limit can be displayed in one display field. As soon as the simulation of the defects allows the desired quality features to be recognized, securing of the clearing limit and downloading into the control apparatus 7 take place to trigger the clearer 3. The production of yarn can now be taken up with the optimized clearing limit.

As described above, images of yarn defects can be stored as a library in the computer 10 and called up. These images can correspond to real depictions like photographs which to this end are digitized and stored. As the number of images input in this way is limited, further images, which show yarn defects which are not prestored because they have differences which are too small from the prestored images, can be produced from two images by interpolation with known image processing algorithms.

For performing the process for clearing yarn according to exemplary embodiments of the present invention, the following steps are to be performed:

a) storing (in a memory) viewable displays of examples of defects in the yarn for several values of parameters of said defects, such parameters being, e.g., deviation of the diameter or mass of the yarn with respect to a standard of mean value and the length of defects extending along said yarn;

b) setting and storing a first clearing limit for eliminating defects in a yarn;

c) displaying examples of defects corresponding to the actual clearing limit (or corresponding to points outside of or within said limit), for judgement by an operator;

d) upon request by the operator, modifying the clearing limit and displaying examples of defects corresponding to the modified clearing limit; and e) storing said modified clearing limit and operating a yarn clearer with said stored clearing limit.

Step c) may also comprise the displaying of the number and/or the position of the yarn defects within a simulation of a web or fabric made from the yarn cleared by the set clearing limit and the displaying of fabrics made with yarn comprising defects which are not eliminated by said clearing limit.

Figure 13A:
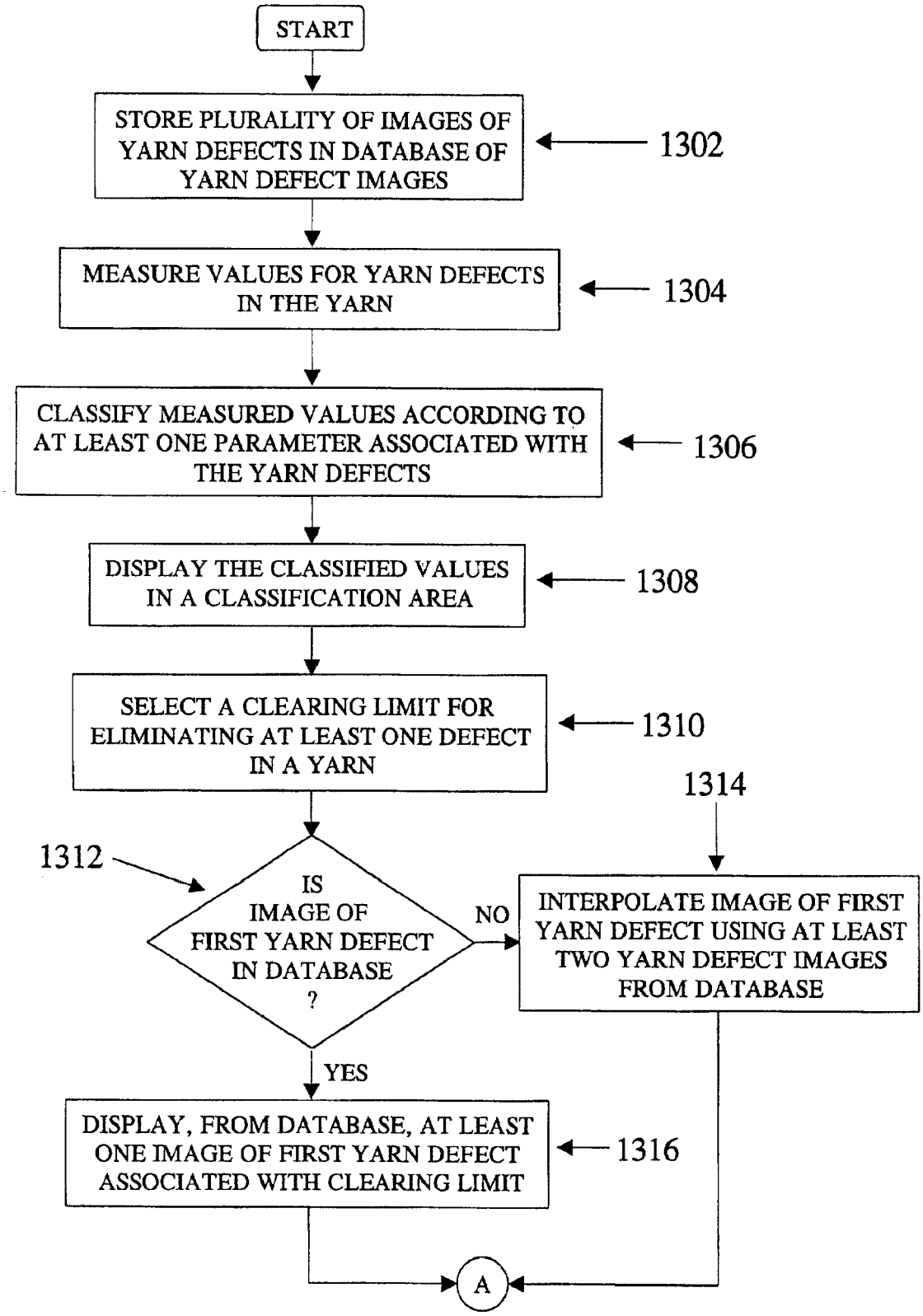
FIGS. 13A and 13B are flowcharts illustrating the steps carried out for clearing yarn in accordance with an exemplary embodiment of the present invention.
Figure 13B:
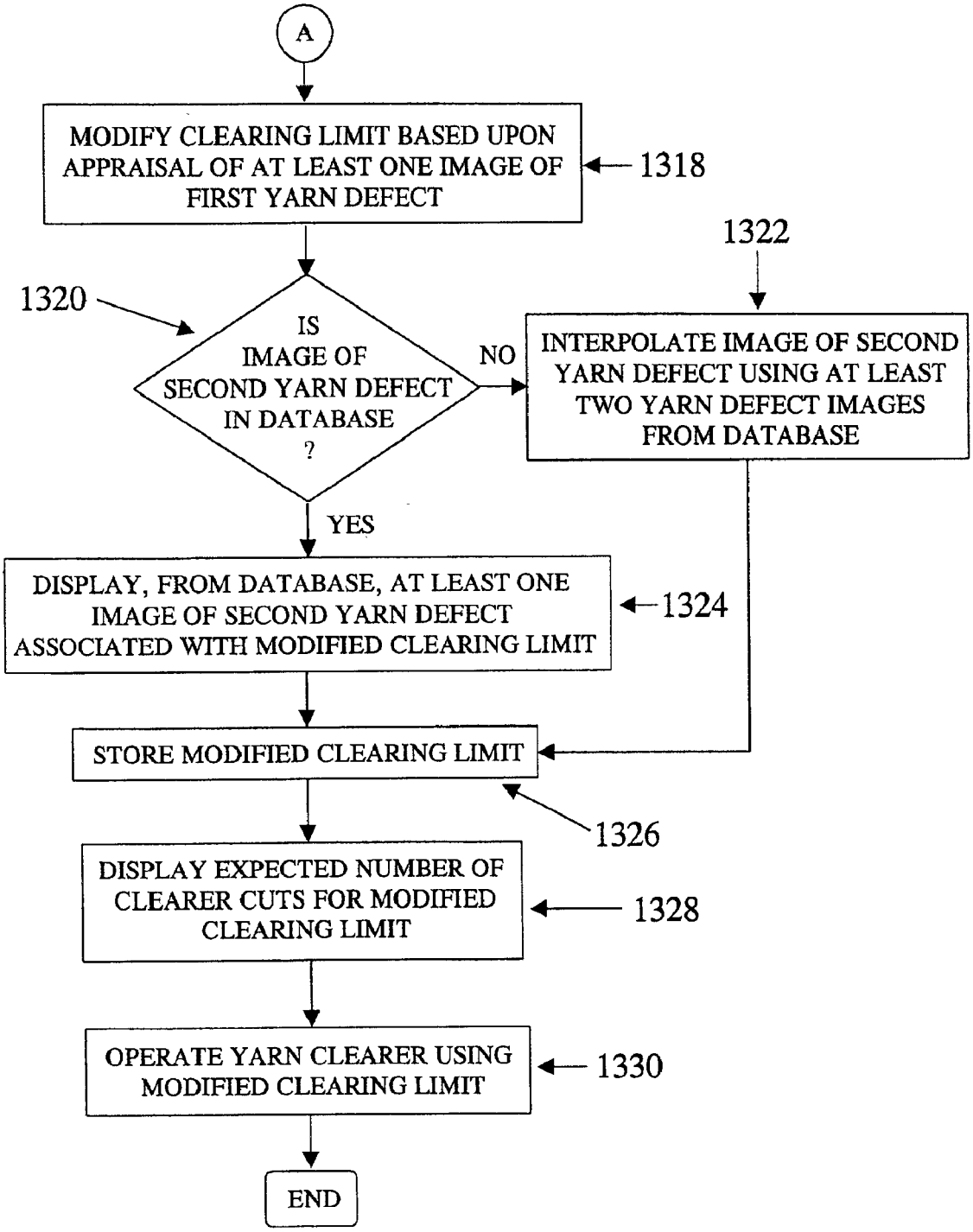

FIGS. 13A and 13B are flowcharts illustrating the steps carried out for clearing yarn in accordance with an exemplary embodiment of the present invention. In step 1302 of FIG. 13A, a plurality of images of yarn defects is stored in a database of yarn defect images. According to exemplary embodiments, each of the plurality of images of yarn defects is stored in the database of yarn defect images according to at least one of a clearing limit and a yarn type. In step 1304, values for yarn defects in a yarn are measured. In step 1306, the measured values are classified according to at least one parameter associated with the yarn defects. According to exemplary embodiments, the parameter associated with the yarn defects includes a deviation of a diameter or mass of the yarn from a predetermined value, such as, for example, the average or mean value of the diameter or mass of the yarn. The parameter also includes a length of the yarn defect in the yarn. In step 1308, the classified values are displayed in a classification area.

In step 1310, a clearing limit is selected for eliminating at least one defect in the yarn. According to exemplary embodiments, the clearing limit is selected from the classification area. In step 1312, a determination is made as to whether or not an image of a first yarn defect associated with the clearing limit is stored in the database of yarn defect images. If it is determined in step 1312 that an image of the first yarn defect is stored in the database, in step 1316, at least one image of the first yarn defect associated with the clearing limit is displayed from the database of yarn defect images. The at least one image of the first yarn defect includes yarn defects that are not eliminated by the clearing limit. If it is determined in step 1312 that an image of the first yarn defect is not stored in the database, in step 1314, an image of the first yarn defect is interpolated using at least two yarn defect images from the database of yarn defect images.

After either step 1314 or 1316 of FIG. 13A, in step 1318 of FIG. 13B, the clearing limit is modified based upon an appraisal of the displayed at least one image of the first yarn defect. According to exemplary embodiments, the modified clearing limit is selected from the classification area. In step 1320, a determination is made as to whether or not an image of a second yarn defect associated with the modified clearing limit is stored in the database of yarn defect images. If it is determined in step 1320 that an image of the second yarn defect is stored in the database, in step 1324, at least one image of the second yarn defect associated with the modified clearing limit is displayed from the database of yarn defect images. The at least one image of the second yarn defect includes yarn defects that are not eliminated by the modified clearing limit. If it is determined in step 1320 that an image of the second yarn defect is not stored in the database, in step 1322, an image of the second yarn defect is interpolated using at least two yarn defect images from the database of yarn defect images.

In step 1326, the modified clearing limit is stored. In step 1328, an expected number of clearer cuts for the modified clearing limit is displayed. If the user is satisfied with the quality of the end product (based upon an appraisal of the displayed yarn defect images), then in step 1330, a yarn clearer is operated using the modified clearing limit. If the user in not satisfied with the quality, the process returns to step 1318 to allow the user to modify the clearing limit and display additional yarn defect images associated with the newly-modified clearing limit, until a satisfactory quality has been attained.

Figure 14:
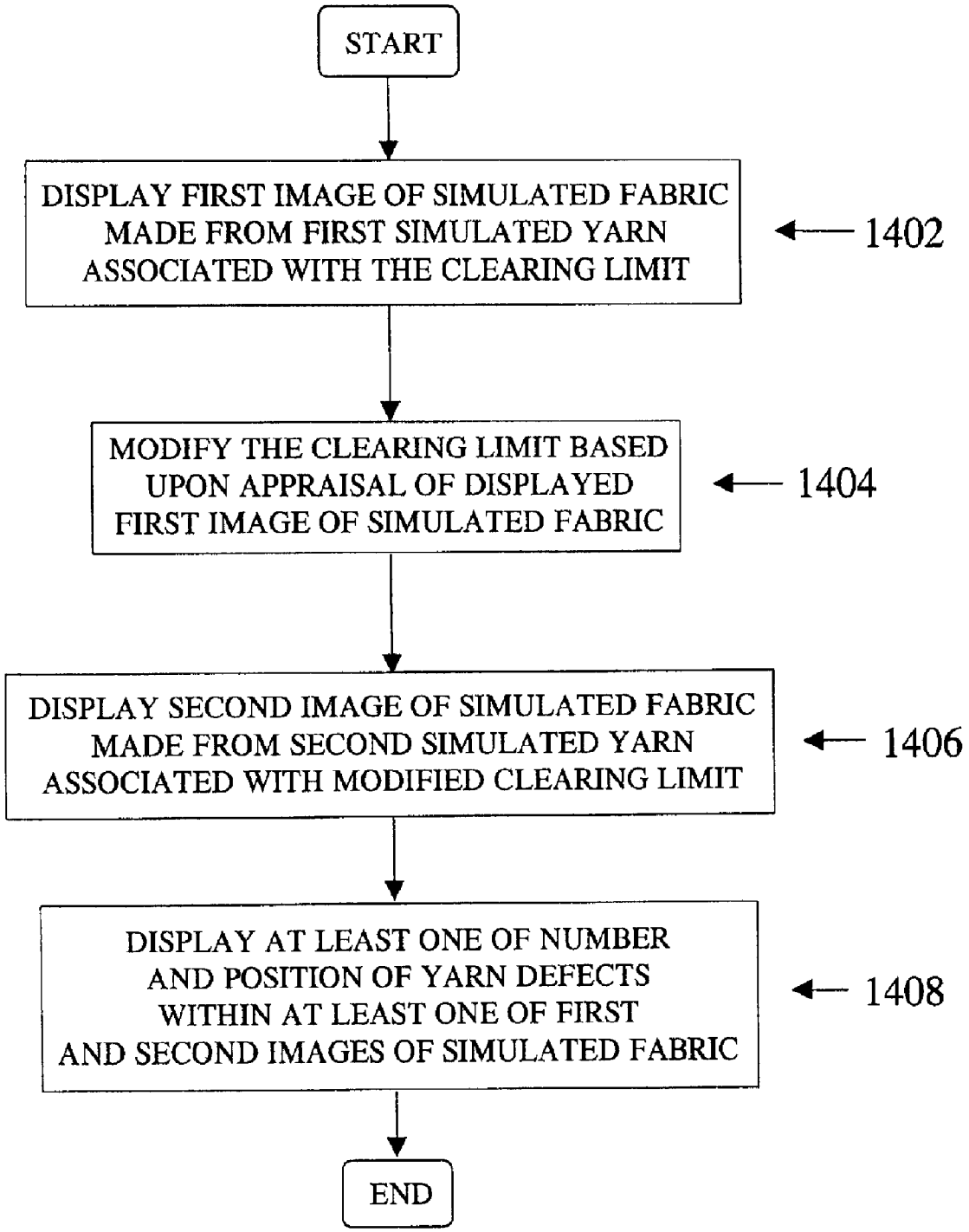
FIG. 14 is a flowchart illustrating the steps carried out for displaying yarn defect images in accordance with an exemplary embodiment of the present invention.

FIG. 14 is a flowchart illustrating the steps carried out for displaying yarn defect images in accordance with an exemplary embodiment of the present invention. In step 1402, a first image of a simulated fabric made from a first simulated yarn associated with the clearing limit is displayed. The first simulated yarn includes yarn defects that are not eliminated by the clearing limit. In step 1404, the clearing limit is modified based upon an appraisal of the displayed first image of the simulated fabric. In step 1406, a second image of the simulated fabric made from a second simulated yarn associated with the modified clearing limit is displayed. The second simulated yarn includes yarn defects that are not eliminated by the modified clearing limit. In step 1408, at least one of a number and position of yarn defects within the first or second images of the simulated fabric is displayed.

As shown in FIG. 1, a system for yarn clearing includes a computer 10. The system for yarn clearing includes an evaluation unit 5 that determines properties of a yarn, a controller, such as, for example, control apparatus 7, for establishing a clearing limit, and a yarn clearer 3 that clears defects from the yarn in accordance with the established clearing limit.

The computer 10 includes a memory that stores a database of yarn defect images. The memory of computer 10 also stores the steps of a computer program to store a plurality of images of yarn defects in the database of yarn defect images. According to exemplary embodiments, each of the plurality of images of yarn defects is stored in the database of yarn defect images according to at least one of a clearing limit and a yarn type.

The memory of computer 10 stores the steps of a computer program to measure values for yarn defects in the yarn using, for example, the evaluation unit 5. The memory of computer 10 also stores the steps of a computer program to classify the measured values according to at least one parameter associated with the yarn defects. According to exemplary embodiments, the at least one parameter associated with the yarn defects includes a deviation of at least one of a diameter and a mass of the yarn from a predetermined value, such as, for example, the average or mean value of the diameter or mass of the yarn. The at least one parameter also includes a length of the yarn defect in the yarn. The memory of computer 10 also stores the steps of a computer program to display the classified values in a classification area.

The memory of computer 10 stores the steps of a computer program to select a clearing limit for eliminating at least one defect in a yarn. According to exemplary embodiments, the clearing limit is selected from the classification area. The memory of computer 10 also stores the steps of a computer program to display, from the database of yarn defect images, at least one image of a first yarn defect associated with the clearing limit. The at least one image of the first yarn defect includes yarn defects that are not eliminated by the clearing limit. The memory of computer 10 stores the steps of a computer program to modify the clearing limit based upon an appraisal of the displayed at least one image of the first yarn defect and store the modified clearing limit. According to exemplary embodiments, the modified clearing limit is selected from the classification area.

The memory of computer 10 stores the steps of a computer program to display, from the database of yarn defect images, at least one image of a second yarn defect associated with the modified clearing limit. The at least one image of the second yarn defect includes yarn defects that are not eliminated by the modified clearing limit. The memory of computer 10 also stores the steps of a computer program to interpolate an image of at least one of the first and second yarn defects using at least two yarn defect images from the database of yarn defect images, if the image of at least one of the first and second yarn defects is not stored in the database of yarn defect images.

The memory of computer 10 stores the steps of a computer program to display an expected number of clearer cuts for the modified clearing limit and operate a yarn clearer 3 using the modified clearing limit.

The memory of computer 10 stores the steps of a computer program to display a first image of a simulated fabric made from a first simulated yarn associated with the clearing limit, wherein the first simulated yarn includes yarn defects that are not eliminated by the clearing limit. The memory of computer 10 also stores the steps of a computer program to modify the clearing limit based upon an appraisal of the displayed first image of the simulated fabric. The memory of computer 10 stores the steps of a computer program to display a second image of the simulated fabric made from a second simulated yarn associated with the modified clearing limit, wherein the second simulated yarn includes yarn defects that are not eliminated by the modified clearing limit. The memory of computer 10 also stores the steps of a computer program to display at least one of a number and position of the yarn defects within at least one of the first and second images of the simulated fabric.

The computer 10 includes a processor 13 for accessing the memory of computer 10 to execute the computer program. The computer 10 also includes means for displaying yarn defect images, such as, for example, using screen 11.

It will be appreciated by those of ordinary skill in the art that the present invention can be embodied in various specific forms without departing from the spirit or essential characteristics thereof. The presently disclosed embodiments are considered in all respects to be illustrative and not restrictive. The scope of the invention is indicated by the appended claims, rather than the foregoing description, and all changes that come within the meaning and range of equivalence thereof are intended to be embraced.

What is claimed is:

1. Device for adjusting clearing limits, comprising:

a yarn clearer;

a computer, connected to the yarn clearer, configured to execute the step of:

starting from a clearing limit, retrieving and displaying prestored displays of defects in an end product that make an effect of the defects in the end product visible; and a means, connected to the computer, for displaying examples of defects.

2. Device according to claim 1, wherein the computer has a program for producing defect images.

3. Device according to claim 1, wherein fields which can be selected thereon are provided, by means of which the calculation of a clearing limit can be triggered.

4. A method for adjusting clearing limits, comprising the steps of:

selecting a clearing limit for eliminating at least one defect in a yarn;

displaying, from a database of yarn defect images, at least one image of a first yarn defect associated with the clearing limit, wherein the at least one image of the first yarn defect includes yarn defects that are not eliminated by the clearing limit;

modifying the clearing limit based upon an appraisal of the displayed at least one image of the first yarn defect; and storing the modified clearing limit.

5. The method of claim 4, further comprising the step of:

storing a plurality of images of yarn defects in the database of yarn defect images.

6. The method of claim 5, wherein each of the plurality of images of yarn defects is stored in the database of yarn defect images according to at least one of a clearing limit and a yarn type.

7. The method of claim 4, further comprising the step of:

displaying, from the database of yarn defect images, at least one image of a second yarn defect associated with the modified clearing limit, wherein the at least one image of the second yarn defect includes yarn defects that are not eliminated by the modified clearing limit.

8. The method of claim 7, further comprising the step of:

interpolating an image of at least one of the first and second yarn defects using at least two yarn defect images from the database of yarn defect images, if the image of at least one of the first and second yarn defects is not stored in the database of yarn defect images.

9. The method of claim 4, further comprising the step of:

displaying an expected number of clearer cuts for the modified clearing limit.

10. The method of claim 4, wherein the step of displaying further comprises the step of:

displaying a first image of a simulated fabric made from a first simulated yarn associated with the clearing limit, wherein the first simulated yarn includes yarn defects that are not eliminated by the clearing limit.

11. The method of claim 10, wherein the step of displaying further comprises the step of:

modifying the clearing limit based upon an appraisal of the displayed first image of the simulated fabric.

12. The method of claim 11, wherein the step of displaying further comprises the step of:

displaying a second image of the simulated fabric made from a second simulated yarn associated with the modified clearing limit, wherein the second simulated yarn includes yarn defects that are not eliminated by the modified clearing limit.

13. The method of claim 12, wherein the step of displaying further comprises the step of:

displaying at least one of a number and position of the yarn defects within at least one of the first and second images of the simulated fabric.

14. The method of claim 4, further comprising the step of:

measuring values for yarn defects in the yarn.

15. The method of claim 14, further comprising the steps of:

classifying the measured values according to at least one parameter associated with the yarn defects; and displaying the classified values in a classification area.

16. The method of claim 15, wherein the clearing limit is selected from the classification area.

17. The method of claim 15, wherein the modified clearing limit is selected from the classification area.

18. The method of claim 15, wherein the at least one parameter associated with the yarn defects includes a deviation of at least one of a diameter and a mass of the yarn from a predetermined value.

19. The method of claim 15, wherein the at least one parameter associated with the yarn defects includes a length of the yarn defect in the yarn.

20. The method of claim 4, further comprising the step of:

operating a yarn clearer using the modified clearing limit.

21. A system for adjusting clearing limits, comprising:

a memory that stores a database of yarn defect images and the steps of a computer program to:

select a clearing limit for eliminating at least one defect in a yarn, display, from the database of yarn defect images, at least one image of a first yarn defect associated with the clearing limit, wherein the at least one image of the first yarn defect includes yarn defects that are not eliminated by the clearing limit, modify the clearing limit based upon an appraisal of the displayed at least one image of the first yarn defect, and store the modified clearing limit;

a processor for accessing the memory to execute the computer program; and means for displaying yarn defect images.

22. The system of claim 21, further comprising:

an evaluation unit that determines properties of the yarn;

a controller for establishing the clearing limit; and a yarn clearer that clears defects from the yarn in accordance with the established clearing limit.

23. The system of claim 21, wherein the memory stores steps of a computer program to:

store a plurality of images of yarn defects in the database of yarn defect images.

24. The system of claim 23, wherein each of the plurality of images of yarn defects is stored in the database of yarn defect images according to at least one of a clearing limit and a yarn type.

25. The system of claim 21, wherein the memory stores steps of a computer program to:

display, from the database of yarn defect images, at least one image of a second yarn defect associated with the modified clearing limit, wherein the at least one image of the second yarn defect includes yarn defects that are not eliminated by the modified clearing limit.

26. The system of claim 25, wherein the memory stores steps of a computer program to:

interpolate an image of at least one of the first and second yarn defects using at least two yarn defect images from the database of yarn defect images, if the image of at least one of the first and second yarn defects is not stored in the database of yarn defect images.

27. The system of claim 21, wherein the memory stores steps of a computer program to:

display an expected number of clearer cuts for the modified clearing limit.

28. The system of claim 21, wherein the memory stores steps of a computer program to:

display a first image of a simulated fabric made from a first simulated yarn associated with the clearing limit, wherein the first simulated yarn includes yarn defects that are not eliminated by the clearing limit.

29. The system of claim 28, wherein the memory stores steps of a computer program to:

modify the clearing limit based upon an appraisal of the displayed first image of the simulated fabric.

30. The system of claim 29, wherein the memory stores steps of a computer program to:

display a second image of the simulated fabric made from a second simulated yarn associated with the modified clearing limit, wherein the second simulated yarn includes yarn defects that are not eliminated by the modified clearing limit.

31. The system of claim 30, wherein the memory stores steps of a computer program to:

display at least one of a number and position of the yarn defects within at least one of the first and second images of the simulated fabric.

32. The system of claim 22, wherein the memory stores steps of a computer program to:

measure values for yarn defects in the yarn.

33. The system of claim 32, wherein the memory stores steps of a computer program to:

classify the measured values according to at least one parameter associated with the yarn defects; and display the classified values in a classification area.

34. The system of claim 33, wherein the clearing limit is selected from the classification area.

35. The system of claim 33, wherein the modified clearing limit is selected from the classification area.

36. The system of claim 33, wherein the at least one parameter associated with the yarn defects includes a deviation of at least one of a diameter and a mass of the yarn from a predetermined value.

37. The system of claim 33, wherein the at least one parameter associated with the yarn defects includes a length of the yarn defect in the yarn.

38. The system of claim 22, wherein the memory stores steps of a computer program to:

operate the yarn clearer using the modified clearing limit.

* * * * *